US005183590A

United States Patent [19]

Carter et al.

[11] Patent Number: 5,183,590

[45] Date of Patent: Feb. 2, 1993

[54] CORROSION INHIBITORS

[75] Inventors: Charles G. Carter, Silver Spring; Vladimir Jovancicevic; Judith A. Hartman, both of Columbia; Robert P. Kreh, Jessup, all of Md.

[73] Assignee: W. R. Grace & Co.-Conn, New York, N.Y.

[21] Appl. No.: 782,359

[22] Filed: Oct. 24, 1991

[51] Int. Cl.[5] ..... C23F 11/14; C23F 11/16

[52] U.S. Cl. ..... 252/392; 252/393; 252/394; 252/395; 252/389.61; 252/389.62; 252/180; 252/80; 562/488; 562/490; 562/553; 562/564; 562/565

[58] Field of Search ..... 252/391, 392, 393, 394, 252/395, 389.61, 389.62, 180, 80; 252/180, 80; 562/488, 490, 553, 564, 565

[56] References Cited

U.S. PATENT DOCUMENTS

| | | | |
|---|---|---|---|
| 3,429,963 | 2/1969 | Shedlovsky | 424/56 |
| 3,671,448 | 6/1972 | Kowalski | 22/180 |
| 3,776,850 | 12/1973 | Pearson et al. | 252/174.24 |
| 3,799,951 | 3/1974 | Guthrie et al. | 552/10 |
| 3,929,874 | 12/1975 | Beerman et al. | 562/564 |
| 4,627,977 | 12/1986 | Gaffar et al. | 424/52 |
| 4,654,159 | 3/1987 | Bush et al. | 424/259 |
| 4,661,341 | 4/1987 | Benedict et al. | 424/48 |
| 4,846,650 | 7/1989 | Benedict et al. | 424/55 |
| 4,971,724 | 11/1990 | Kalota et al. | 252/390 |

FOREIGN PATENT DOCUMENTS

| | | |
|---|---|---|
| 2408591 | 9/1975 | Fed. Rep. of Germany . |
| 3739610 | 11/1987 | Fed. Rep. of Germany . |
| 2100264A | 12/1982 | United Kingdom . |

OTHER PUBLICATIONS

*Amino Acids As Corrosion Inhibitors in HCl Acid Solutions,* Werkstofle and Korrosion 39, 512-517 (1988), Hackerman et al.

Chemical Abstracts 81 7748r (1974), Y. Matsuzawa et al.

Chem. Soc. Jap. 40, 2977, J. Oh-hashi et al.

Chemical Abstracts 57, 16732g (1962) Hamptman et al.

*Primary Examiner*—Robert L. Stoll
*Assistant Examiner*—Valerie Fee
*Attorney, Agent, or Firm*—James P. Barr

[57] ABSTRACT

A composition and method for inhibiting corrosion of ferrous metals in contact with an aqueous solution comprising adding to the system from 0.1 to 500 ppm of an aminohydroxysuccinic acid compound selected from group consisting of compounds of the generalized formulas:

A)

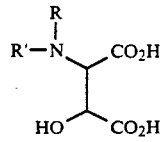

wherein R is H or $C_1$ to $C_6$ alkyl, optionally substituted with —OH, —$CO_2H$, —$SO_3H$ or phenyl, $C_4$ $C_7$ cycloalkyl, or phenyl which is optionally substituted with —OH, or —$CO_2H$, and R′ is H, $C_1$ to $C_6$ alkyl, optionally substituted with —OH or $CO_2H$; and

B)

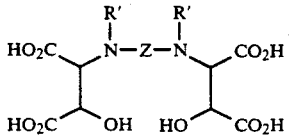

wherein R′ is as above, and Z is selected from the group consisting of i) —$(CH_2)_n$— wherein n is an integer from 2 to 10, ii) —$(CH_2)_2$—X—$(CH_2)_2$— wherein X is —O—, —S—, —NR″—; wherein R″ is selected from the group consisting of H, $C_1$ to $C_6$ alkyl, hydroxyalkyl, carboxyallkyl, acyl, —C(O)OR‴ wherein R‴ is $C_1$ $C_6$ alkyl or benzyl and

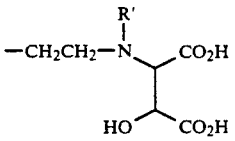

wherein R′ is as above, iii)

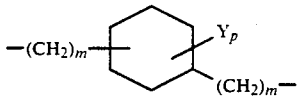

wherein Y is H, $C_1$ to $C_6$ alkyl, alkoxy, halogen, —$CO_2H$, or —$SO_3H$, m is independently 0 or 1 and p is 1 or 2, and iv)

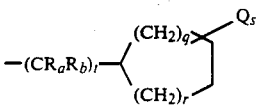

wherein $R_a$ and $R_b$ are independently H or $C_1$ to $C_6$ alkyl, Q is H or $C_1$ to $C_6$ alkyl and S is 0, 1 or 2; t is independently 0, 1, 2 or 3 and q is 0, 1, 2, or 3, and r is 1 or 2; or water soluble salts thereof.

11 Claims, No Drawings

CORROSION INHIBITORS

FIELD OF THE INVENTION

This invention relates to certain novel compositions and their method of use for controlling corrosion in aqueous systems, and more particularly to certain aminohydroxysuccinic acid compounds which have been found to be effective for controlling corrosion of ferrous-based metals which are in contact with aqueous systems.

BACKGROUND OF THE INVENTION

Iron and iron-based metal alloys containing alloys such as mild steel are well-known materials used in constructing the apparatus of aqueous systems. In these systems water circulates, contacts the iron based metal surface, and may be concentrated, such as by evaporation of a portion of the water from the system. Even though such metals are readily subject to corrosion in such environments, they are used over other metals due to their strength and availability.

It is known that various materials which are naturally or synthetically occurring in the aqueous systems, especially systems using water derived from natural resources such as seawater, rivers, lakes and the like, attack ferrous-based metals. The term "ferrous-based metals", as used herein, shall mean any iron metal and/or metal alloys containing iron therein. Typical systems in which the iron metal parts are subject to corrosion include evaporators, single and multi-pass heat exchangers, cooling towers, and associated equipment and the like. As the water passes through or over the system, a portion of the system water evaporates thereby increasing the concentration of the dissolved materials contained in the system. These materials approach and reach a concentration at which they may cause severe pitting and corrosion which eventually requires replacement of the metal parts. Various corrosion inhibitors have been previously used to treat these systems.

For example, chromates, inorganic phosphates and/or polyphosphates have been used to inhibit the corrosion of metals which are in contact with water. The chromates, though effective, are highly toxic and consequently present handling and disposal problems. While phosphates are non-toxic, due to the limited solubility of calcium phosphate, it is difficult to maintain adequate concentrations of phosphates in many aqueous systems. Polyphosphates are also relatively non-toxic, but tend to hydrolyze to form orthophosphate which in turn, like phosphate itself, can create scale and sludge problems in aqueous systems (e.g. by combining with calcium in the system to form calcium phosphate). Moreover, where there is concern over eutrophication of receiving waters, excess phosphate compounds can serve as nutrient sources. Borates, nitrates, and nitrites have also been used for corrosion inhibition. These too can serve as nutrients in low concentrations, and/or represent potential health concerns at high concentrations.

Environmental considerations have also recently increased concerns over the discharge of other corrosion inhibiting metals such as zinc, which previously were considered acceptable for water treatment.

Much recent research has concerned development of organic corrosion inhibitors which can reduce reliance on the traditional inorganic inhibitors. Among the organic inhibitors successfully employed are numerous organic phosphonates. These compounds may generally be used without detrimentally interfering with other conventional water treatment additives. However, environmental concerns about the discharge of phosphorus in the form of organic phosphonates have begun to be heard. It is anticipated that in the future this will lead to limitations on the use of organic phosphonates in water treatment.

Another serious problem in industrial aqueous systems, especially in cooling water systems, evaporators, and boilers is the deposition onto heat transfer surfaces of scale, particularly scale-forming salts such as certain carbonates, hydroxides, silicates and sulfates of cations such as calcium and magnesium. Much of the water used in these systems contain various amounts of scale-forming salts. Because of the evaporation which takes place in these aqueous systems, the solids in the water become more concentrated; and, because of the inverse solubility of calcium carbonate, calcium sulfate and other hardness salts, the problem of the formation of water-insoluble scales on the heat transfer surfaces is intensified. In addition, many organic corrosion inhibitors (e.g. hydroxyethylidene diphosphonic acid) are very sensitive to calcium i.e., they have a high tendency to precipitate with calcium ions in solution.

Thus, there is a continuing need for safe and effective water treating agents which can be used to control corrosion, particularly when a substantial concentration of dissolved calcium is present in the system water. Water treating agents of this type are particularly advantageous when they are phosphorus-free.

SUMMARY OF THE INVENTION

It is an object of this invention to provide a method of inhibiting corrosion of ferrous-based metals in contact with an aqueous systems.

It is another object of this invention to provide a method of inhibiting corrosion of ferrous-based metals in contact with an aqueous system and which provides surprisingly enhanced results.

It is another object of this invention to provide certain novel compositions which comprise aminohydroxysuccinic acid compounds.

It is another object to provide non-phosphorus containing organic corrosion inhibitors having high activity and low levels of toxicity.

In accordance, with the present invention, there has been provided a method for inhibiting corrosion of ferrous-based metals which are in contact with an aqueous system comprising adding to the system a corrosion inhibiting amount of an aminohydroxysuccinic acids having the following generalized formulas:

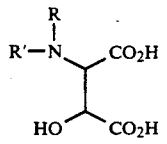

A)

wherein R is H or $C_1$ to $C_6$ alkyl which may be optionally substituted with —OH, —$CO_2H$, —$SO_2H$ or phenyl, $C_4$ to $C_7$ cycloalkyl, or phenyl which is optionally substituted with —OH, or —$CO_2H$, and R' is H, $C_1$ to $C_6$ alkyl, optionally substituted with —OH or $CO_2H$; and

B)

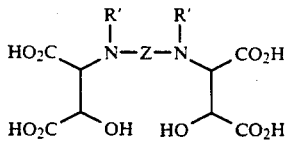

wherein R' is as above, and Z is selected from the group consisting of i) $-(CH_2)_n-$wherein n is an integer from 2 to 10, ii) $-(CH_2)_2-X-(CH_2)_2-$wherein X is —0—, —S—, —NR"—; wherein R" is selected from the group consisting of H, C to $C_6$ alkyl, hydroxyalkyl, carboxyalkyl, acyl, —C(O)OR''' wherein R''' is selected from the group consisting of $C_1$ to $C_6$ alkyl or benzyl, and

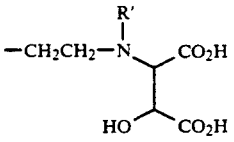

wherein R' is as above, iii)

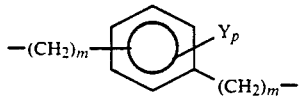

wherein Y is H, $C_1$ to $C_6$ alkyl, alkoxy, halogen, $-CO_2H$, or $-SO_3H$, m is independently 0 or 1 and p is 1 or 2, and iv)

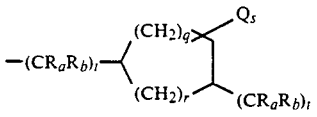

wherein $R_4$ and $R_b$ are independently H or $C_1$ to $C_6$ alkyl, Q is H or $C_1$ to $C_6$ alkyl, s is 0, 1 or 2, t is independently 0, 1, 2 or 3 and q is 0, 1, 2, or 3, and r is 1 or 2; or water soluble salts thereof.

Also provided in accordance with the present invention is a method of inhibiting corrosion of ferrous-based metals in contact with an aqueous system comprising adding to the system the combination of the aminohydroxysuccinic acid of this invention together with a phosphate.

Also in accordance with the present invention, there have been provided certain novel compositions which are aminohydroxysuccinic acids which have the following generalized formula:

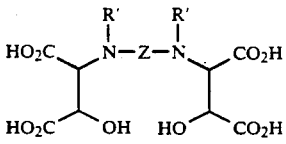

wherein each R' is independently, H, $C_1$ to $C_6$ alkyl, optionally substituted with —OH or $-CO_2H$, and Z is selected from the group consisting of i) $-(CH_2)_2-$ wherein n is an integer from 2 to 10, ii) $-(CH_2)_2-X-(CH_2)_2-$wherein X is —0—, —S—, —NR"—; wherein R" is selected from the group consisting of H, $C_1$ to $C_6$ alkyl, hydroxyalkyl, carboxyalkyl, acyl, —C(0)OR''' wherein R" is selected from the group consisting of $C_1$ to $C_6$ alkyl or benzyl, and

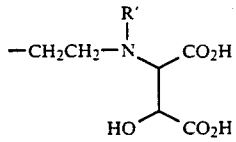

wherein R' is as above, iii)

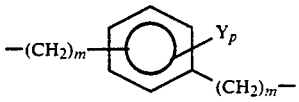

wherein Y is H, $C_1$ to $C_6$ alkyl, alkoxy, halogen, $-CO_2H$, or $-SO_3H$, m is independently 0 or 1 and p is 1 or 2, and iv)

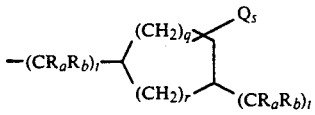

wherein $R_a$ and $R_b$ are independently H or $C_1$ to $C_6$ alkyl, Q is H or $C_1$ to $C_6$ alkyl, s is 0, 1 or 2, t is independently 0, 1, 2 or 3 and q is 0, 1, 2, or 3, and r is 1 or 2; or water soluble salts thereof.

DETAILED DESCRIPTION

This invention is directed to certain aminohydroxysuccinic acid compounds and to their use as corrosion control agents for treating aqueous systems. The method of this invention comprises adding to an aqueous system, in an amount effective to inhibit corrosion of ferrous-based metals which are in contact with the aqueous system an aminohydroxysuccinic acid compound having the following general formula:

A)

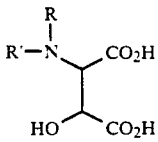

wherein R is H or $C_1$ to $C_6$ alkyl, optionally substituted with —OH, $-CO_2H$, $-SO_2H$ or phenyl, $C_4$ to $C_7$ cycloalkyl, or phenyl which is optionally substituted with —OH, or $-CO_2H$, and R' is H, $C_1$ to $C_6$ alkyl, optionally substituted with—OH or $CO_2H$; and

B)

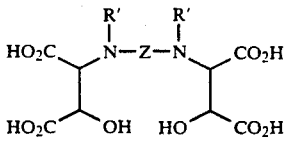

wherein R' is as above, and Z is selected from the group consisting of i) $-(CH_2)_n-$wherein n is an integer from 2 to 10, ii) $-(CH_2)_2-X-(CH_2)_2-$wherein X is —0—, —S—, —NR"—; wherein R" is selected from the group consisting of H, $C_1$ to $C_6$ alkyl, hydroxyalkyl, carboxyalkyl, acyl, —C(0)OR''' wherein R''' is selected from the group consisting of $C_1$ to $C_6$ alkyl or benzyl and

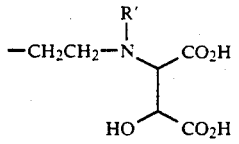

wherein R' is as above, iii)

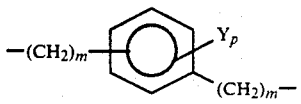

wherein Y is H, $C_1$ to $C_6$ alkyl, alkoxy, halogen, —$CO_2H$, or —$SO_3H$, m is independently 0 to 1 and p is 1 or 2, and iv)

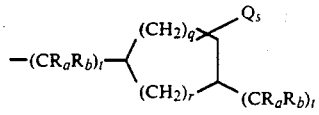

wherein $R_a$ and $R_b$ are independently H or $C_1$ to $C_6$ alkyl, Q is H or $C_1$ to $C_6$ alkyl, s is 0, 1 or 2, t is independently 0, 1, 2 or 3 and q is 0, 1, 2, or 3, and r is 1 or 2 or water soluble salts thereof.

The present invention is also directed to certain novel compositions comprising amino-hydrosuccinic acids which have the following generalized formula:

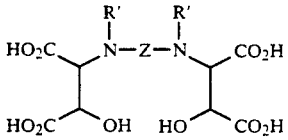

wherein each R' is independently, H, $C_1$ to $C_6$ alkyl, optionally substituted with —OH or —$CO_2H$, and Z is selected from the group consisting of i) —$(CH_2)_n$— wherein n is an integer from 2 to 10, ii) —$(CH_2)_2$—X—$(CH_2)_2$—wherein X is —O—, —S—, —NR''—; wherein R'' is selected from the group consisting of H, $C_1$ to $C_6$ alkyl, hydroxyalkyl, carboxyalkyl, acyl, —C(O)OR''' wherein R''' is selected from the group consisting of $C_1$ to $C_6$ alkyl or benzyl, and

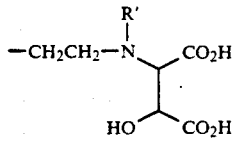

wherein R' is as above, iii)

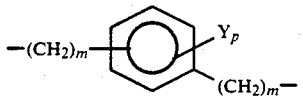

wherein Y is H, $C_1$ to $C_6$ alkyl, alkoxy, halogen, —$CO_2H$, or —$SO_3H$, m is independently 0 or 1 and p is I or 2, and iv)

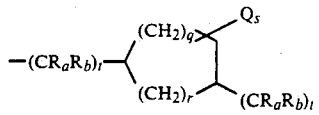

wherein $R_a$ and $R_b$ are independently H or $C_1$ to $C_6$ alkyl, Q is H or $C_1$ to $C_6$ alkyl, s is 0, 1 or 2, t is independently 0, 1, 2 or 3 and q is 0, 1, 2, or 3, and r is 1 or 2; or water soluble salts thereof.

The aminohydroxysuccinic acid compounds of the present invention may be prepared by reacting an epoxysuccinate or an admixture of an epoxysuccinate and a tartrate with about a molar equivalent of an amine compound in an aqueous medium to form an alkali metal salt of an aminohydroxysuccinic acid compound. This procedure is more fully described in U.S. Pat. No. 3,929,874 to Beerman et al which is incorporated herein by reference in its entirety. See also Y. Matsuzawa et al, Chemical Abstracts 81, 77484r (1974), J. Oh-hashi et al, Chem. Soc. Jap., 2977 (1967) and H. Hamptmann et al, Chemical Abstracts 57, 6732g (1962) which are also incorporated herein by reference in their entirety.

The aminohydroxysuccinic acid compounds of this invention have been found to be effective for inhibiting corrosion in aqueous systems. Thus, in accordance with this aspect of the invention, the corrosion of ferrous metals which are in contact with an aqueous system may be prevented or inhibited by adding to the system a corrosion inhibiting amount of the aminohydroxysuccinic acid compounds of this invention, or their water soluble salts.

The precise dosage of the corrosion inhibiting agents of this invention depends, to some extent, on the nature of the aqueous system in which it is to be incorporated and the degree of protection desired. In general, however, the concentration of aminohydroxysuccinic acid composition maintained in the system can be from about 0.05 to about 500 ppm. Within this range, generally low dosages of about 200 ppm or less are preferred, with a dosage of about 100 ppm or less being most preferred for many aqueous systems, such as for example, many open recirculating cooling water systems. Typically dosages of about 0.I ppm or more are preferred, with a dosage of about 0.5 to 2 ppm or more being most preferred. The exact amount required with respect to a particular aqueous system can be readily determined by one of ordinary skill in the art in conventional manners. As is typical of most aqueous systems, the pH is preferably maintained at 7 or above, and is most preferably maintained at 8 or above.

It is considered an important feature of this invention, that the claimed compositions be calcium insensitive. Calcium sensitivity refers to the tendency of a compound to precipitate with calcium ions in solution. The calcium insensitivity of the claimed compositions permits their use in aqueous systems having water with relatively high hardness. The test for calcium insensitivity of a compound, as used in this application, involves a cloud point test (hereinafter the CA500 cloud point test) where the compound is added to hard water containing 500 ppm calcium ion (as $CaCO_3$) which is buffered at pH 8.3 using 0.005 M borate buffer and which has a temperature of 60° C. The amount of compound which can be added to the solution until it becomes turbid (the cloud point) is considered to be an indicator of calcium insensitivity.

The calcium insensitive compounds of this invention have cloud points of at least about 50 ppm as determined by the CA500 cloud point test, and preferably have cloud points of at least about 75 ppm, and most preferably have cloud points of at least 100 ppm as determined by the CA500 cloud point test.

In addition to being effective corrosion inhibitors when used as the sole corrosion inhibiting agent in the aqueous system, it has now been discovered that combinations of the aminohydroxysuccinic acids of this invention, together with a phosphate, provide unexpectedly superior corrosion inhibiting effects. Accordingly, another embodiment of this invention is directed to a method of inhibiting corrosion of ferrous-based metals in contact with an aqueous system comprising adding to the system the aminohydroxysuccinic acids as hereinbefore defined together with a phosphate in amounts effective to inhibit corrosion. The weight ratio of aminohydroxysuccinic acid to phosphate employed herein is not, per se, critical to the invention and is of course determined by the skilled artisan for each and every case while taking into consideration the water quality and the desired degree of protection in the particular situation. A preferred weight ratio of aminohydroxysuccinic acid:phosphate on an actives basis is within the range of from 1:10 to 20:1 with a range of from 2:1 to 10:1 being most preferred.

The corrosion inhibiting compositions of this invention may be added to the system water by any convenient mode, such as by first forming a concentrated solution of the treating agent with water, preferably containing between 1 and 50 total weight percent of the amino/epoxy succinic acid composition, and then feeding the concentrated solution to the system water at some convenient point in the system. In many instances, the treatment compositions may be added to the make-up water or feed water lines through which water enters the system. For example, an injection calibrated to deliver a predetermined amount periodically or continuously to the make-up water may be employed.

The present invention is particularly useful in the treatment of cooling water systems which operate at temperatures between 60° F. and 200° F., particularly open recirculating cooling water systems which operate at temperatures of from about 80° F. to 150° F.

It will be appreciated that while the chemical corrosion inhibiting compositions of this invention may be used as the sole corrosion inhibitor for the aqueous system, other conventional water treatment compositions customarily employed in aqueous systems may advantageously be used in combination with the claimed treatment agents. Thus, other water treatment additives which may be used include, but are not limited to, biocides, scale inhibitors, chelants, sequestering agents, dispersing agents, other corrosion inhibitors, polymeric agents (e.g. copolymers of 2-acrylamido-2-methyl propane sulfonic acid and methacrylic acid or polymers of acrylic acid and methacrylic acid), and the like.

Without further elaboration, it is believed that one of skill in the art, using the preceding detailed description, can utilize the present invention to its fullest extent.

The following examples are provided to illustrate the invention in accordance with the principles of this invention, but are not to be construed as limiting the invention in any way except as indicated in the appended claims. All parts and percentages are by weight unless otherwise indicated.

EXAMPLE 1

The following compounds (1-4) were evaluated for their effectiveness in inhibiting corrosion in aqueous systems using an Aerated Solution Bottle test according to the following procedure and used two standard corrosive waters having the following compositions:

| Water A | Water B |
|---|---|
| 12.8 mg/l $CaCl_2$ | 25.6 mg/l $CaCl_2$ |
| 110.7 mg/l $CaSO_4$—$2H_2O$ | 221.4 mg/l $CaSO_4$—$2H_2O$ |
| 54.6 mg/l $MgSO_4$ | 109.2 mg/l $MgSO_4$ |
| 75.7 mg/l $NaHCO_3$ | 351.4 mg/l $NaHCO_3$ |

Compound 1 HAsp—HE

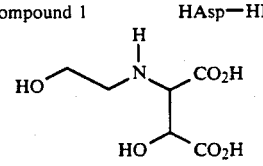

Compound 2 BHS—HD

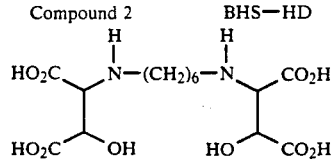

Compound 3 BSH—XD

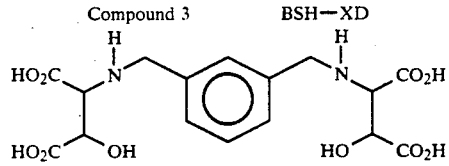

Compound 4 BHS—DAM

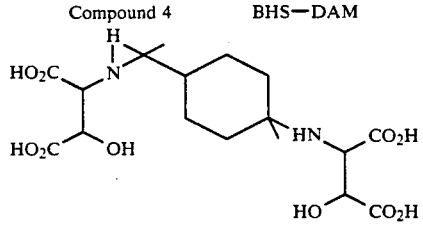

Mild steel coupons (4.5 in.×0.5 in.) were immersed in 15% hydrochloric acid for 15 minutes, then rinsed sequentially in saturated sodium bicarbonate solution, distilled water and isopropanol, dried and stored in a desiccator. They were weighed prior to use in the corrosion test.

The desired amount of corrosion inhibitor was dissolved in 850 ml of one of the standard corrosive waters listed above. The solution was heated in a thermostatted bath at 55° C. After the temperature had equilibrated th-e pH of the solution was adjusted to 8.5. Two coupons were suspended in the solution and air was passed into the solution at 250 ml/min. After 48 hours, the coupons were removed and cleaned with steel wool, rinsed, dried, and weighed again. The rate of corrosion was calculated from the weight loss and was expressed in mils per year (mpy). The results are shown in the following table.

TABLE 1

| Inhibitor | Dosage (ppm) | Corrosion Rate in mpy Water A | Water B |
|---|---|---|---|
| Blank | — | 70 | 73 |
| Compound 1 | 100 | — | 4.0 |
| HAsp—HE | 75 | — | 6.9 |
| | 60 | 3.4 | — |
| | 50 | 6.7 | — |
| | 40 | 32 | — |
| Compound 2 | 75 | — | 3.9 |
| BHS—HD | 60 | — | 10 |
| | 50 | 3.4 | 17 |
| | 40 | 11 | — |
| Compound 3 | 75 | 2.4 | 7.5 |
| BHS—XD | 60 | — | 15 |
| | 50 | 3.4 | — |
| | 40 | 17 | — |
| Compound 4 | 75 | 2.7 | — |
| BHS—DAM | 60 | 3.0 | 6.9 |
| | 50 | 3.3 | 26 |
| | 40 | 12 | — |

EXAMPLE 2

The test procedure described in Example 1 was repeated in standard corrosive Water A for the following compositions:

| | |
|---|---|
| Comparison | |
| NTA | Nitrilotriacetic acid |
| Asp—MA | Aspartic acid monoacetate |
| Asp | Aspartic acid |
| Gly | Glycine |
| Glu | Glutamic acid |
| Examples | |
| HAsp—MA | Hydroxyaspartic acid monoacetate |
| HAsp—MA—HE | N-(Hydroxyethyl)-hydroxyaspartic acid monoacetate |
| Ser—HS | N-(Hydroxysuccinyl)serine |
| HS—HSer | N-(Hydroxysuccinyl)homoserine |
| HAsp—HE | N-(Hydroxyethyl)hydroxyaspartic acid |
| DHP—HS | N-(2,3-Dihydroxypropyl)hydroxyaspartic acid |
| HSAnA | N-(Hydroxysuccinyl)anthranilic acid |
| HS—CysA | N-(Hydroxysuccinyl)cysteic acid |
| HS—PrA | N-(Hydroxysuccinyl)propyl amine |
| BzlA—HS | N-(Hydroxysuccinyl)benzyl amine |
| IDHS | Iminodisuccinic acid |
| HAsp | Hydroxyaspartic acid |
| Asp—HS | N-(Hydroxysuccinyl)aspartic acid |
| Ala—HS | N-(Hydroxysuccinyl)alanine |
| Met—HS | N-(Hydroxysuccinyl)methionine |
| HAsp—PA | N-(2-carboxyethyl),N-(carboxymethyl)-hydroxyaspartic acid |
| HAsp—HEP | N-(2-hydroxyethyl),N-(2-carboxyethyl)hydroxyaspartic acid |
| BHS—ED | N,N'-Bis(hydroxysuccinyl)ethylenediamine |
| BHS—HD | N,N'-Bis(hydroxysuccinyl)-1,6-hexanediamine |
| BHS—DTA | sym-N,N'-Bis(hydroxysuccinyl)diethylenetriamine |
| BHS—DAM | N,N'-Bis(hydroxysuccinyl)-1,8-p-diaminomenthane |
| BHS—XD | N,N'-Bis(hydroxysuccinyl)-m-xylenediamine |
| BHS—DAB | N,N'-Bis(hydroxysuccinyl)-3,5-diaminobenzoic acid |
| BHS—BAMC | N,N'-Bis(hydroxysuccinyl)-1,3-cyclohexanebis(methylamine) |
| BHS—DAHP | N,N'-Bis-(hydroxysuccinyl)-1,3-diamino-2-hydroxypropane |
| BHS—BD | N,N'-Bis-(hydroxysuccinyl)-1,4-butanediamine |
| BHS—ED100 | N,N'-Bis(hydroxysuccinyl)di(2-aminoethyl)ether |
| BHS—DD | N,N'-Bis-(hydroxysuccinyl)decanediamine |

-continued

| | |
|---|---|
| THS—TREN | N,N',N''-Tris(hydroxysuccinyl)-tris(2-aminoethyl)amine |
| BHS—DTA—AC | sym-N'-Acetyl-N,N''-bis(hydroxysuccinyl)diethylenetriamine |
| BHS—DTA—MC | sym-N,N''-Bis(hydroxysuccinyl)diethylenetriamine N'-methyl carbamate |
| BHS—DTA—BZ | sym-N'-Benzoyl-N,N''-bis(hydroxysuccinyl)diethylenetriamine |
| BHS—DTA—HL | sym-N'-Hexanoyl-N,N''-bis(hydroxysuccinyl)diethylenetriamine |
| BHS—ED—P | N,N'-(bishydroxysuccinyl),N-(2-carboxyethyl)ethylenediamine |
| HS—HA | N-(hydroxysuccinyl)-n-hexylamine |
| HS—AHL | N-(hydroxysuccinyl)-6-hydroxy-1-hexylamine |
| β-Ala—HS | N-(hydroxysuccinyl)-β-alanine |
| AMB—HS | N-(5-carboxy-2-methylphenyl)-hydroxyaspartic acid |
| HS—SAT | N-(4-methyl-3-sulfophenyl)-hydroxyaspartic acid |

TABLE II

CORROSION INHIBITION - AERATED BOTTLE TEST

| Treatment | Corrosion Rate* (mpy) 50 ppm | 75 ppm | 100 ppm | 150 ppm |
|---|---|---|---|---|
| HAsp—MA | 55 | 8.1 | 3.1 | 1.3 |
| HAsp—MA—HE | — | — | 22 | 6.1 |
| Ser—HS | — | 41 | 5.4 | — |
| HS—HSer | — | 33 | 2.6 | — |
| HAsp—HE | 6.7 | — | — | — |
| DHP—HS | 3.7 | — | — | — |
| HSAnA | — | — | $29^{88}$ | 2.7 |
| HSCysA | — | — | — | $2.9^{141}$ |
| HS—PrA | 25 | 3.6 | 3.9 | 4.6 |
| BzlA—HS | 4.2 | 4.1 | 4.2 | — |
| IDHS | 28 | 1.6 | — | — |
| HAsp | | | | |
| Asp—HS | 45 | 13 | — | — |
| Ala—HS | 28 | 2.7 | — | — |
| Met—HS | 49 | 5.9 | — | — |
| HAsp—PA | 9.8 | 2.5 | — | — |
| HAsp—HEP | 3.2 | 2.1 | — | — |
| BHS—ED | 14 | — | — | — |
| BHS—HD | 3.4 | — | — | — |
| BHS—DTA | 3.4 | 2.2 | 1.7 | — |
| BHS—DAM | 3.3 | 2.7 | — | — |
| BHS—XD | 3.4 | 2.4 | — | — |
| BHS—DAB | 57 | 40 | 25 | 7.7 |
| BHS—BAMC | 2.3 | — | — | — |
| BHS—DAHP | — | 20 | 4.2 | — |
| BHS—BD | — | 3.9 | 1.6 | — |
| BHS—ED100 | — | 28 | 3.5 | — |
| BHS—DD | — | 31 | 12 | — |
| THS—TREN | — | 10.4 | 2.8 | — |
| BHS—DTA—AC | 17 | — | — | — |
| BHS—DTA—MC | 15 | — | — | — |
| BHS—DTA—BZ | — | 2.0 | — | — |
| BHS—DTA—HL | 37 | 9.9 | — | 9.9 |
| BHS—ED—P | 26 | 2.1 | — | — |
| HS—HA | 43 | — | 2.5 | — |
| HS—AHL | 34 | — | 4.1 | — |
| β-Ala—HS | 14 | 1.9 | — | — |
| IDHS—P | 35 | 1.5 | 1.6 | — |

Note: The superscripts 88 and 141 are dosage amounts in ppm.

TABLE IIA

CORROSION INHIBITION BY COMPARISON COMPOUNDS AERATED BOTTLE TEST

| Treatment | Corrosion Rate* (mpy) 150 ppm | 200 ppm |
|---|---|---|
| NTA | 58 | 56 |
| Asp—MA | 58 | 64 |
| Asp | — | 77 |
| Gly | — | 76 |

TABLE IIA-continued

| CORROSION INHIBITION BY COMPARISON COMPOUNDS AERATED BOTTLE TEST | | |
|---|---|---|
| | Corrosion Rate* (mpy) | |
| Treatment | 150 ppm | 200 ppm |
| Glu | — | 78 |

*Untreated Blank - 70 mpy

As is apparent from the foregoing comparative data, it is not possible to predict with aminohydroxysuccinic acids will provide effective corrosive inhibition on the basis of structure alone. Clearly, the above comparative compounds are structurally similar to the claimed compositions of this invention and yet they were ineffective corrosion inhibitors.

EXAMPLE 3

This example demonstrates the synergism exhibited between aminohydroxysuccinic acids and phosphate. Test water was prepared to simulate the actual aqueous systems found in cooling tower systems. The water contained 99 parts per million (ppm) $CaSO_4$, 13 ppm $CaCl_2$, 55 ppm $MgSO_4$ and 176 ppm $NaHCO_3$. To separate aliquots of the test water were added the additives listed in Table I. The solution was then adjusted to pH=8.5 with NaOH(aq). A clean, preweighed SAE 1010 mild steel coupon was suspended in 0.9 liters of test solution, which was stirred at 54° C. for 24 hours. The mild steel specimen was then cleaned, dried under vacuum at 60° C. and weighed. The corrosion rates, expressed in mils (thousandths of an inch) per year (mpy) were determined from this weight loss and are listed in Table III for each additive.

TABLE III

| Mild Steel Corrosion Rates With Aminohydroxysuccinic Acid/Phosphate Combinations | | | |
|---|---|---|---|
| Run No. | ppm $PO_4$≡ | ppm aminohydroxy-succinic acid | Corrosion Rate (mpy) |
| (1) | 0 | 0 | 60 |
| (2) | 3 | 0 | 49.3 |
| (3) | 15 | 0 | 22 |
| (4) | 3 | 12 (BHS—ED) | 5.2(b) |
| (5) | 0 | 18 (BHS—ED) | 40 |
| (6) | 3 | 12 (BHS—HD) | 3.2(b) |
| (7) | 0 | 15 (BHS—HD) | 45 |

(b)replacing BHS—ED or BHS—HD with citric acid resulted in a corrosion rate of 23 mpy.

EXAMPLE 4

This example demonstrates the effectiveness of the compounds HSAnA, BHS-DAB, and AMB-HS in comparison to HS-SAT as herein before defined. As is apparent from the results provided in Table IV, the presence of a $CO_2H$ group on the benzene ring in the aminohydroxysuccinic acid compounds provided enhanced corrosion inhibiting effects where were surprising and unexpected in view of the relative ineffectiveness of HS-SAT wherein a $SO_3H$ group was substituted for the $CO_2H$ group.

TABLE IV

| Inhibitor | Dosage ppm | Corrosion Rate in mpy |
|---|---|---|
| Blank | — | 70 |
| HSAnA | 150 | 2.7 |
| | 88 | 29 |
| BHS—DAB | 150 | 7.7 |
| | 100 | 25 |
| | 75 | 40 |
| | 50 | 57 |
| AMB—HS | 150 | 2.3 |
| | 100 | 30 |
| HS—SAT | 250 | 34 |

TABLE IV-continued

| Inhibitor | Dosage ppm | Corrosion Rate in mpy |
|---|---|---|
| | 200 | 33 |

We claim:

1. A method for inhibiting corrosion of ferrous metals in contact with an aqueous solution comprising adding to the system from 0.1 to 500 ppm of an aminohydroxysuccinic acid compound selected from group consisting of compounds of the generalized formulas:

A)

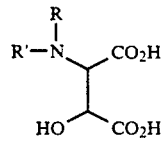

wherein R is H or $C_1$ to $C_6$ alkyl, optionally substituted with —OH, —$CO_2H$, —$SO_3H$ or phenyl, $C_4$ to $C_7$ cycloalkyl, or phenyl which is optionally substituted with —OH, or —$CO_2H$, and R′ is H, $C_1$ to $C_6$ alkyl, optionally substituted with OH OH or $CO_2H$; and

B)

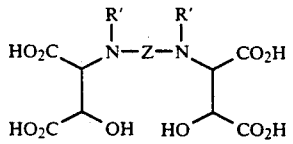

wherein R′ is as above, and Z is selected from the group consisting of i) —$(CH_2)_n$—wherein n is an integer from 2 to 10, ii) —$(CH_2)_2$—X—$(CH_2)_2$—wherein X is —0—, water soluble salts thereof.

2. A method according to claim 1 wherein the aminohydroxysuccinic acid has the generalized formula A and R′ is H.

3. A method according to claim 2 wherein the aminohydroxysuccinic acid is selected from the group consisting of hydroxyaspartic acid monoacetate, N-(hydroxyethyl)hydroxyaspartic acid, 2,3-dihydroxypropyl hydroxyaspartic acid, N-(2-hydroxyethyl) hydroxyaspartic and N-(2-carboxyethyl) hydroxyaspartic acid.

4. A method according to claim 1 wherein the aminohydroxysuccinic acid has the generalized formula B and Z is —$(CH_2)$—wherein n is an integer from 2-10

5. A method according to claim 4 wherein the aminohydroxysuccinic acid is selected from the group consisting of N,N′-bis(hydroxysuccinyl)ethylenediamine, N,N′-bis(hydroxysuccinyl)-1,6-hexanediamine and N,N′-bis(hydroxysuccinyl)1,4-butanediamine.

6. A method according to claim 4 wherein the aminohydroxysuccinic acid is N,N′-bis(hydroxysuccinyl)1,8-p-diaminomenthane.

7. A method according to claim 1 wherein the aminohydroxysuccinic acid is added to the aqueous system in combination with a phosphate.

8. A method according to claim 7 wherein the aminohydroxysuccinic acid and phosphate are in a weight ratio on an actives basis, in the range of from 1:10 to 20:1, respectively.

9. A method according to claim 7 wherein the aminohydroxysuccinic acid and phosphate are in a weight ratio, on an actives basis, in the range of from 2:1 to 10:1, respectively.

10. A method according to claim 7 wherein the aminohydroxysuccinic acid is N,N′-bis-(hydroxysuccinyl)ethylenediamine.

11. A method according to claim 1 wherein the amount of aminohydroxysuccinic acid is from 0.1 to 100 ppm.

* * * * *